US005524745A

United States Patent [19]

Wohlrab

[11] Patent Number: 5,524,745

[45] Date of Patent: Jun. 11, 1996

[54] FILM HINGE FOR A COIN ACCEPTOR

[76] Inventor: Ekhart Wohlrab, Alte Dorfstr. 29, 21684 Stade, Germany

[21] Appl. No.: 250,805

[22] Filed: May 27, 1994

(Under 37 CFR 1.47)

[51] Int. Cl.[6] ..... G07F 1/04

[52] U.S. Cl. ..... 194/345

[58] Field of Search ..... 194/321, 323, 194/345, 344, 347, 348, 349; 193/DIG. 1; 453/62; 206/0.82

[56] References Cited

U.S. PATENT DOCUMENTS

| | | | |
|---|---|---|---|
| 3,907,086 | 9/1975 | Willis . | |
| 3,978,962 | 9/1976 | Gregory, Jr. . | |
| 4,089,400 | 5/1978 | Gregory, Jr. . | |
| 4,139,093 | 2/1979 | Holmes | 206/0.82 |
| 4,318,464 | 3/1982 | Henville . | |
| 4,353,452 | 10/1982 | Shah et al. . | |
| 4,376,480 | 3/1983 | Abe | 194/323 |
| 4,881,630 | 11/1989 | Kobayashi et al. | 194/203 |

FOREIGN PATENT DOCUMENTS

| | | | |
|---|---|---|---|
| 0499137 | 2/1992 | European Pat. Off. | G07F 3/04 |
| 7713687 | 10/1978 | Germany | E05D 1/02 |
| 3001532 | 1/1980 | Germany | G07D 5/00 |
| 3045736 | 6/1982 | Germany | G07F 1/04 |
| 3718710 | 12/1988 | Germany | G07D 3/12 |
| 1558948 | 1/1980 | United Kingdom | G07F 3/02 |
| WO91/01028 | 7/1990 | WIPO | G07F 1/04 |

*Primary Examiner*—F. J. Bartuska
*Attorney, Agent, or Firm*—Senniger, Powers, Leavitt & Roedel

[57] ABSTRACT

A coin acceptor which accepts authentic coins includes a main plate and a side plate corresponding to the main plate for allowing coins to pass therebetween. A plastic film hinge pivotally attaches the side plate to the main plate. A spring biases the side plate against the main plate. The film hinge is formed from polyoxymethylane. The film hinge has a film section and V-shaped film edges on either side of the film section. The film hinge is mounted at an angle approximately 30 degrees off of a vertical line. The spring is hairpin shaped with first and second shanks and the side plate has a supporting member for receiving the spring. The second shank detachably engages the main plate for biasing the side plate against the main plate.

20 Claims, 2 Drawing Sheets

24
34
26
22
20
36

32
18
30
2
14
10
24
34
28
44
2
22
26
20
42
16
12
48
62
46
3
50
3

FILM HINGE FOR A COIN ACCEPTOR

BACKGROUND OF THE INVENTION

Coin acceptors for testing the validity of inserted objects and coins have been in use for a long time. A common construction for a coin acceptor comprises a housing having a main plate and a track carrier plate parallel to and at a distance from the main plate. One or more track sections are located between the plates for allowing coins to pass therethrough. In electronic coin acceptors, sensors are placed in the plates for sensing different characteristics of passing coins. The track carrier plate is often hinged to the main plate. When a coin return knob is actuated in a vending machine, the carrier plate is pivoted away from the main plate so that any remaining coins can be removed or fall out. A spring pretensions or biases the track carrier plate to return the track carrier plate to its original position after it has been temporarily pivoted away by the actuation of the coin return knob.

A problem with existing coin acceptors is that, due to manufacturing tolerances and wear, the track carrier plate does not precisely move back to the original position in a reproducible fashion after pivoting out from the main plate. As a consequence, opposing sensors in the plates can be misaligned and variations in measured values or other measuring errors can occur. The constant loading of the track carrier by the pretensioning spring can also deform the track carrier, especially if it is made of plastic. This too can alter the alignment of the coin sensors. While the general concept of a film hinge is known, film hinges have not been used in conjunction with vending machines and coin acceptors.

SUMMARY OF THE INVENTION

Among the objects of the present invention are to provide improved coin acceptors which are reliable and compact; to provide improved coin acceptors wherein the coin sensors remain aligned after the coin acceptor has been repeatedly opened and shut; to provide improved coin acceptors having a film hinge for reliably connecting the track carrier plate to the main plate; to provide improved coin acceptors having a spring biased track carrier plate which does not deform the hinge or plate; and to provide improved coin acceptors which are easy and inexpensive to manufacture.

Generally, one form of the invention is a coin acceptor including a main plate and a side plate corresponding to the main plate for allowing the passage of coins therebetween. The coin acceptor includes a plastic film hinge which pivotally attaches the side plate to the main plate and a spring which biases the side plate against the main plate. The film hinge may be formed from polyoxymethylane. The film hinge may have a film section with V-shaped film edges on either side of the film section. The spring may be hairpin shaped with a shank for detachably engaging the main plate.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
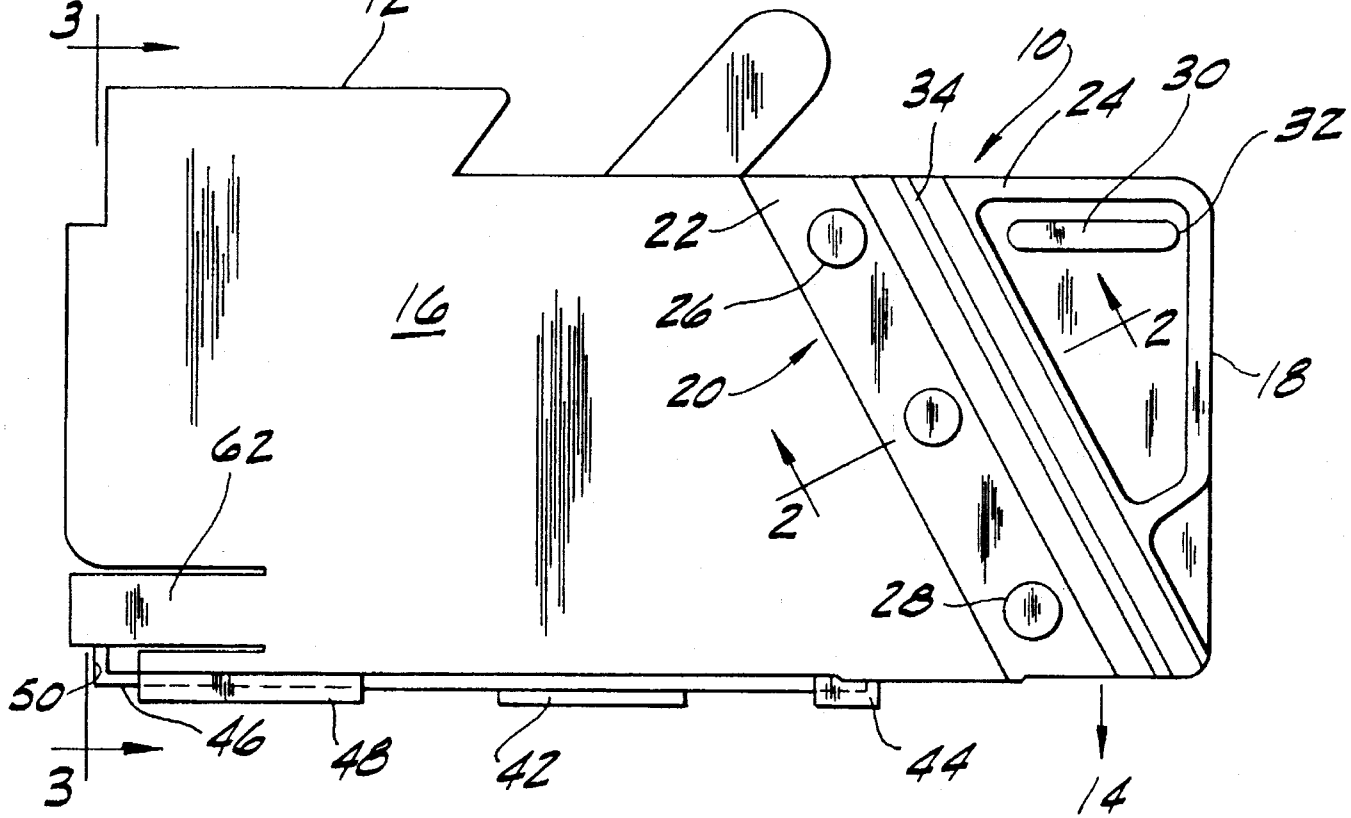
FIG. 1 shows a side view of a coin acceptor in accordance with the invention.

FIG. 1 shows a side view of a coin acceptor within a housing 10. Coins are inserted in an insertion slot 12 at the upper left end and roll along one or more coin paths (not shown) before leaving housing 10 at the lower right end in the direction of arrow 14. A track carrier plate 16 and a main plate 18, both preferably made of a plastic material, are arranged in parallel vertical planes and define the coin path(s) therebetween. All of the coin acceptor parts which are normally located between plates 16 and 18 including all of the coin sensors housed in plates 16 and 18 are generally understood by those skilled in the art and, therefore, are not shown in the present drawings.

Track carrier plate 16 and main plate 18 are connected to each other via a film hinge 20. Film hinge 20 consists of a first hinge section 22 and a second hinge section 24 which are connected to track carrier plate 16 and to main plate 18, respectively. Hinge section 22 includes three bores 26 through which pins 28 of track carrier plate 16 extend in an approximately fitting relationship. Pins 28 are formed as a part of track carrier plate 16. Pins 28 are permanently connected to hinge section 22 by ultrasound deformation. An oblong pin 30 is formed on an elevated offset of main plate 18. Pin 30 extends through a correspondingly formed longitudinal opening 32 of hinge section 24. Hinge section 24 is adapted in its contour to the contour of main plate 18 in this area.

Figure 2:
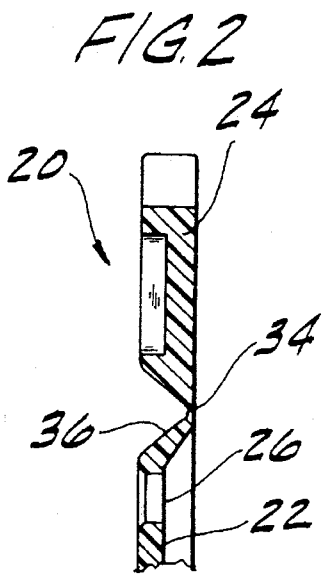
FIG. 2 shows a sectional view through FIG. 1 along line 2—2.
Figure 4:
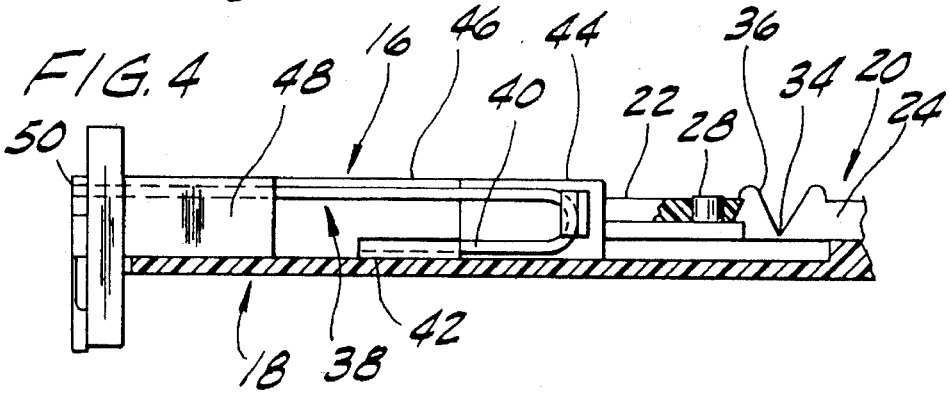
FIG. 4 shows a bottom view below the coin acceptor of FIG. 1 with a sectional view through the main plate.
Figure 5:
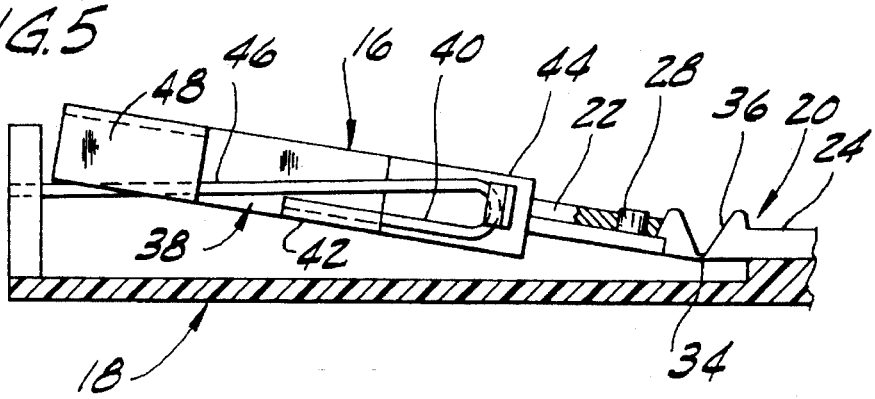
FIG. 5 shows a view similar to that of FIG. 4 but with the track carrier plate pivoted away.

FIG. 2 shows a sectional view through film hinge 20 in FIG. 1 along line 2—2. Hinge sections 22 and 24 are connected to one another via a film section 34 located between hinge sections 22 and 24. The edges of hinge sections 22 and 24 adjacent to film section 34 form a V-shaped groove 36. The walls of groove 36 form a stop as against each other when film hinge 20 is opened and sections 22 and 24 are pivoted against each other. Groove 36 preferably allows a pivoting angle of up to 90°. As shown in FIGS. 4 and 5, the parts of hinge sections 22 and 24 immediately adjacent to film section 34 are considerably thicker than film section 34 in order to reinforce and provide a more stable stopping mechanism and to prevent film hinge 20 from becoming overloaded.

In practice, film hinge 20 is preferably made of plastic, particularly polyoxymethylane. Film hinge 20 should extend over the height of plates 16 and 18 to provide stability. Film hinge 20 can be formed from one piece of plastic with track carrier plate 16 or it can be manufactured as a separate part. Since the required qualities of the plastic for track carrier plate 16 may be different than those for film hinge 20, manufacturing film hinge 20 as a separate part may be advantageous. It has been found that film hinge 20 should be made of a plastic whose mechanical qualities do not vary significantly within a broad temperature range. Polyoxymethylane is one such plastic. Film hinge 20 should also be designed using appropriate dimensions and materials to withstand the required number of opening movements of track carrier plate 16 within the temperature limits customary for coin acceptors.

Since film hinge 20 provides little inherent return force and since such a force is also undesirable in the hinge area, a return spring is needed. FIGS. 4 and 5 show a hairpin-shaped spring 38 located on the bottom of track carrier plate 16. Spring 38 is preferably made of round wire. Spring 38 has a shorter shank 40 which rests in a pocket 42 of track carrier plate 16. Shank 40 is thereby supported by track carrier plate 16. The U shaped arc of spring 38 is fixed in a pocket 44. A longer shank 46 of spring 38 extends parallel to shorter shank 40 through a conduit section 48 of track carrier plate 16 and then on over to the side of track carrier plate 16. Shank 46 ends with an upwardly bent section 50 as shown in FIG. 1. Shanks 40 and 46 therefore lie in a plane approximately orthogonal to plates 16 and 18.

As shown in FIG. 5, shank 40 is fixed in position. When track carrier plate 16 is pivoted away from main plate 18, shank 46 and the U shaped arc section of spring 38 are deformed. This deformation biases track carrier plate 16 back toward main plate 18. Shank 40 generally does not deform. This pivoting action takes place, for example, when a return mechanism is actuated in the vending machine so that any coins which may be trapped between plates 16 and 18 fall out. Because shank 46 is guided in conduit section 48, sufficient support is provided in track carrier plate 16. Accordingly, film hinge 20 is not loaded with pressure or flexion.

Figure 3:
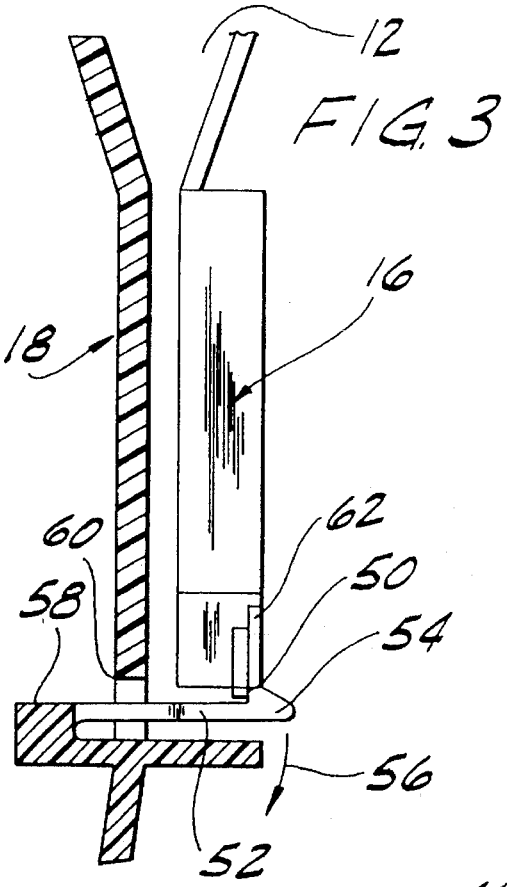
FIG. 3 shows a sectional view through FIG. 1 along line 3—3.
Figure 6:
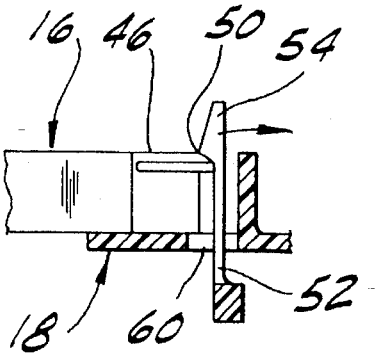
FIG. 6 shows the bottom view in partial section of the coin acceptor of FIG. 1 in the area of the locking mechanism for the track carrier plate.

FIGS. 3 and 6 show a resilient arm 52 formed from the same piece of material as main plate 18. Arm 52 includes a detent 54 on its free end. Detent 54 extends behind and engages bent section 50 of spring shank 46 in the position of arrest. As a result, upon a pivoting motion of track carrier plate 16 like that shown in FIG. 5, shank 46 is fixed which causes a return force for biasing track carrier plate 16 in position against main plate 18. On the other hand, when arm 52 is pivoted in the direction of an arrow 56, track carrier plate 16 can be pivoted completely away from main plate 18 through an angle of about 90°. Accordingly, shank 46 is detachably fastened to main plate 18.

In order to obtain the longest possible spring arm, arm 52 is connected to a section 58 of main plate 18 which section projects from the other side of main plate 18. Arm 52 therefore extends through a corresponding recess 60 of main plate 18.

As shown in FIG. 1, a flap 62 is formed from track carrier plate 16. Flap 62 is positioned adjacent bent section 50. When flap 62 is depressed, it moves track carrier plate 16 back into the operating position and presses bent section 50 back into engagement with detent 54.

The use of film hinge 20 for mounting track carrier plate 16 to main plate 18 not only reduces the expense of manufacture and assembly but also assures that no change of alignment occurs between the coin sensors on track carrier plate 16 and those on main plate 18. This is because of the greatly reduced forces on film hinge 20 and the surface of plates 16 and 18 in the operational mode. This is brought about in part by the vertical support for track carrier plate 16 which reduces forces of pressure and bending in film hinge 20 so that no deformation of the plastic takes place, for example, by cold creep. Accordingly, track carrier plate 16 assumes the same position in a reproducible fashion after it has been pivoted away from main plate 18 and the coin sensors between plates 16 and 18 retain their original alignment. Consequently, minimal scatter is produced in the measuring signals of the coin sensors which could otherwise adversely affect the quality of the recognition of coins. Another benefit of film hinge 20 is its freedom from wear and maintenance and thus its almost unlimited service life.

As also shown in FIG. 1, film hinge 20 is arranged at an angle approximately 30° to the vertical axis of track carrier plate 16. By angling the axis of rotation for film hinge 20, track carrier plate 16 beneficially moves upward as it is opened. Because of the minimal space requirements for film hinge 20, adequate space is available for positioning the coin sensors and it is even possible to position them in the range of film hinge 20 wherein film hinge 20 runs partially over the coin path(s).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A coin acceptor comprising:

a main plate;

a side plate corresponding to the main plate for allowing the passage of coins therebetween;

a plastic film hinge for pivotally attaching the side plate to the main plate; and a spring for biasing the side plate against the main plate;

wherein the spring further comprises a hairpin shaped spring having first and second shanks;

wherein the side plate further comprises a supporting member for receiving the spring;

wherein the first and second shanks lie in a plane orthogonal to the side plate; and wherein the second shank is detachably engaged to the main plate.

2. The coin acceptor of claim 1 wherein the supporting member comprises a pocket along one side of the side plate for receiving the first shank.

3. The coin acceptor of claim 1 wherein the main plate further comprises an arresting arm having a detent at the end of said arm; and wherein the second shank extends beyond the side plate to engage the detent, whereby the spring biases the side plate against the main plate.

4. The coin acceptor of claim 3 wherein the arresting arm and the main plate are formed from a single piece of material.

5. The coin acceptor of claim 1 wherein the supporting member comprises a horizontal pocket for supporting the second shank.

6. The coin acceptor of claim 1 wherein one side of the main plate defines a vertical line and wherein an axis of rotation of the film hinge lies at an angle to the vertical line.

7. The coin acceptor of claim 1 wherein the film hinge comprises a film section and film edges on either side of the film section; and wherein the film edges form a groove which is V-shaped in cross section.

8. The coin acceptor of claim 1 wherein the film hinge comprises a film section and film edges on either side of the film section; and wherein the film edges are thicker than the film section.

9. The coin acceptor of claim 1 wherein the film hinge is formed from polyoxymethylane.

10. A coin acceptor comprising:

a main plate;

a side plate corresponding to the main plate for allowing the passage of coins therebetween;

wherein the main plate and the side plate each include an opposing coin sensor for testing the coins passing therebetween; and a plastic film hinge for pivotally attaching the side plate to the main plate;

wherein the film hinge comprises a film section connecting a film edge on the side plate to a film edge on the main plate; and wherein the film edges are thicker than the film section and abut each other to restrict movement of the side plate away from the main plate to a predetermined angle, whereby the opposing coin sensors are aligned across from one another when the side plate is closed against the main plate.

11. The coin acceptor of claim 10 wherein the film hinge spans the height of at least one of the plates.

12. The coin acceptor of claim 10 wherein the film hinge spans the height of both the side plate and the main plate.

13. The coin acceptor of claim 10 wherein one side of the main plate defines a vertical line and wherein an axis of rotation of the film hinge lies at an angle to the vertical line.

14. The coin acceptor of claim 10 wherein the film edge on the side plate and the film edge on the main plate together form a groove which is V-shaped in cross section.

15. The coin acceptor of claim 10 wherein the film hinge opens through an angle up to about 90°.

16. The coin acceptor of claim 10 wherein the film hinge is formed from polyoxymethylane.

17. The coin acceptor of claim 10 wherein the main plate and the side plate comprise injection-moulded plastic.

18. The coin acceptor of claim 10 wherein the film hinge is formed in one piece with the side plate.

19. A coin acceptor comprising:

a main plate;

a side plate corresponding to the main plate for allowing the passage of coins therebetween;

a plastic film hinge for pivotally attaching the side plate to the main plate; and a spring for biasing the side plate against the main plate;

wherein the film hinge is connected to the side plate via a pin connection formed with ultrasound deformation.

20. The coin acceptor of claim 19 wherein the pin connection further comprises a pin projecting from the side plate and wherein the film hinge receives the pin through an opening for securing the film hinge to the side plate.

* * * * *